US006688876B2

(12) United States Patent
Delabroy et al.

(10) Patent No.: US 6,688,876 B2
(45) Date of Patent: Feb. 10, 2004

(54) LIQUID-FUEL COMBUSTION SYSTEM

(75) Inventors: Olivier Delabroy, Paris (FR); Pierre Bodelin, Vanves (FR); Mahendra Joshi, Allentown, PA (US); Bernard Labegore, Paris (FR); François Lacas, Chatenay Malabry (FR)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 5 days.

(21) Appl. No.: 09/870,500

(22) Filed: Jun. 1, 2001

(65) Prior Publication Data

US 2002/0048735 A1 Apr. 25, 2002

(51) Int. Cl.[7] ..... F23D 11/00
(52) U.S. Cl. ..... 431/2; 431/239
(58) Field of Search ..... 364/500; 310/11; 431/181, 2, 239

(56) References Cited

U.S. PATENT DOCUMENTS

| | | | | |
|---|---|---|---|---|
| 3,836,315 A | | 9/1974 | Shular | |
| 3,861,858 A | | 1/1975 | Hemsath et al. | |
| 4,683,541 A | * | 7/1987 | David | 364/500 |
| 4,851,722 A | * | 7/1989 | Zauderer | 310/11 |
| 5,199,866 A | | 4/1993 | Joshi et al. | |
| 5,449,286 A | | 9/1995 | Snyder et al. | |
| 5,490,775 A | | 2/1996 | Joshi et al. | |
| 5,617,997 A | | 4/1997 | Kobayashi et al. | |
| 5,620,316 A | * | 4/1997 | Duboudin et al. | 431/181 |
| 6,123,542 A | | 9/2000 | Joshi et al. | |

FOREIGN PATENT DOCUMENTS

EP 0 614 044 A2 9/1994

WO 97/06386 A1 2/1997

OTHER PUBLICATIONS

Broadwell, Dahm, Mungal; "Blowout of Turbulent Diffusion Flames", 1984.*

* cited by examiner

*Primary Examiner*—Henry Bennett
*Assistant Examiner*—Sabrina Dagostino
(74) *Attorney, Agent, or Firm*—Burns, Doane, Swecker & Mathis, L.L.P.

(57) ABSTRACT

A process for combustion with the aid of a liquid fuel and a gaseous oxidizer containing from 20% to 100% volume of oxygen, in which the fuel is injected with the aid of an injector. The injector, which has a height "d", is placed inside a glory hole. The glory hole has a height "D" at the end thereof corresponding to the ejection of the gaseous mixture towards the zone of heating of a charge. A coefficient "S" in the following equation is maintained at a value less than or equal to 1 for substantially the entire duration of combustion to ensure the stability of the flame.

$$S = \frac{a_1 V_{equivalent} - a_2 L}{a_3 d(2 - e^{-L/10D})}$$

with $a_1 = 2.5 \cdot 10^{-11}$ $a_2 = 1 \cdot 10^{-9}$, dimensionless $a_3 = (0.875 \cdot \gamma + 0.525) \cdot 10^{-6}$, dimensionless.

In the above equation, "L" is defined as the distance between the end of the liquid fuel injector and the downstream end in the fluid flow direction of the glory hole. "$V_{equivalent}$" is defined either as the equivalent velocity representative of the average velocity of the spray of drops of liquid fuel in the case of mechanical atomizers and being equal to 2.4 $M/(\rho \pi d^2)$, or a velocity equal to 0.5 times $V_{atomization}$, in other cases. "$\gamma$" is defined as the overall (volume) percentage of oxygen in the gases at the exit of the glory hole.

8 Claims, 4 Drawing Sheets

Vatomization = 250 m/s

Vequivalent = 125 m/s *«external atomization»*

LIQUID-FUEL COMBUSTION SYSTEM

This application is related and claims priority under 35 U.S.C. §120 to U.S. patent application Ser. No. 09/447,742, filed Nov. 23, 1999, and under 35 U.S.C. §119 to French patent application Ser. No. 98 15078, filed Nov. 30, 1998, the entire contents of both of which are incorporated by reference herein.

BACKGROUND OF THE INVENTION

1. Field of the Invention

The present invention relates to combustion systems using liquid fuel and oxidizer containing from around 20% to 100% by volume of oxygen (air, oxygen-enriched air, industrially pure oxygen). In this type of burner, the stability of the flame is a condition sine qua non of operation. The present invention makes it possible to define the geometry of the burners of this type so as to ensure the stability of the flame as well as correct positioning of the flame generated by the burner.

2. Brief Description of the Related Art

Numerous high-temperature processes (glass furnace, reheat furnace, incineration furnace, etc.) use combustion and in particular combustion with the aid of liquid fuels. One of the key steps in the combustion of liquid fuel is atomization: the liquid jet must firstly be transformed into drops which are vaporized and then burned. Several means are available for making these drops. A first example is mechanical atomization in ambient air, consisting essentially of impacting the liquid onto a gas at rest. Another example consists in using the intervention of a moving atomization gas, such as air, oxygen, steam, or any other available gas. For further details regarding the various categories of atomizer, reference may be made to the work by A. Lefebvre entitled: "Atomization and Sprays", 1989, published by Taylor & Francis, p. 136 et seq.

The atomizer is generally placed in a glory hole (typically made of a refractory material) into which an oxidizer gas flows. Although in theory there is nothing to prevent the atomizer being positioned set back from the exit plane of the glory hole, nobody has hitherto been able to demonstrate any relationship whatsoever between the stability of the flame and the positioning of this injector in the glory hole.

The expression stable flame should be understood to mean, according to the present invention, a flame for which the average position of its root does not vary substantially over time. This position will typically be tagged with respect to the injector.

In gaseous combustion, the stability of the flame is governed by the recirculation structures formed at the boundary of the gaseous jet (see the article by J E Broadwell, W J A Dahm and M G Mungal, "Blowout of turbulent diffusion flames" published in the $20^{th}$ Symposium (International) on Combustion, by The Combustion Institute, pp 303–310, 1984). The combustion which takes place at the core of these recirculation zones will provide the energy necessary for the stabilization of the flame.

It has been found that the problem of stability is trickier in the case of a liquid-fuel flame than in the case of a gas-fuel flame. Specifically, the vaporization of the drops will consume energy. This energy will no longer be available to sustain the combustion and stabilize the flame. It has therefore been demonstrated that it was necessary to take into account, for this type of flame, an additional factor for stability: the small-sized drops. Specifically, the latter meet two criteria. Firstly, they have the capacity to follow the gaseous flow. It is then possible to trap them in the recirculation zones. Thereafter, they evaporate rapidly and can therefore feed these recirculation zones with gaseous fuel and thus allow the flame to be held according to the same mechanisms as for gas flames.

One means of ensuring the stability of a flame is to create extra recirculation zones (different from the recirculation zones created "naturally" along the jet). In gaseous combustion, it is known from U.S. Pat. No. 5,645,413 to create internal recirculation, whereas it is known from U.S. Pat. No. 4,536,152 and U.S. Pat. No. 5,791,893 to supplement the burner with a flame holder.

Liquid-fuel atomizers furnished with a flame holder (or stabilizer) are described for example in U.S. Pat. No. 4203719 ("disc-shaped baffle") and U.S. Pat. No. 4836772 ("stabilizing ring").

However, the use of flame-holder fittings in enriched-air or pure oxygen flames is generally impossible since the temperature withstand of this type of fitting in this type of flame would be greatly compromised.

SUMMARY OF THE INVENTION

According to a first aspect of the invention, a process for combustion with the aid of a liquid fuel and a gaseous oxidizer containing from 20% to 100% volume of oxygen comprises the steps of injecting the fuel with an injector having an internal height d placed inside a glory hole having an internal height D at its end corresponding to the ejection of the gaseous mixture towards the zone of heating of a charge; maintaining the coefficient S defined by the relation:

$$S = \frac{a_1 V_{equivalent} - a_2 L}{a_3 d(2 - e^{-L/10D})}$$

with $a_1 = 2.5 \cdot 10^{-11}$, seconds $a_2 = 1 \cdot 10^{-9}$, dimensionless $a_3 = (0.875\gamma + 0.525) \cdot 10^{-6}$, dimensionless at a value less than or equal to 1 for substantially the entire duration of combustion, wherein L is defined as the distance between the end of the liquid fuel injection and a downstream end in the fluid flow direction of the glory hole, $V_{equivalent}$ is defined either as the equivalent velocity representative of the average velocity of the spray of drops of liquid fuel in the case of mechanical atomizers and being equal to 2.4 $M/(\rho\pi d^2)$, or a velocity equal to 0.5 times $V_{atomization}$, and $\gamma$ is defined as the overall (volume) percentage of oxygen in the gases at the exit of the glory hole.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figure 1:
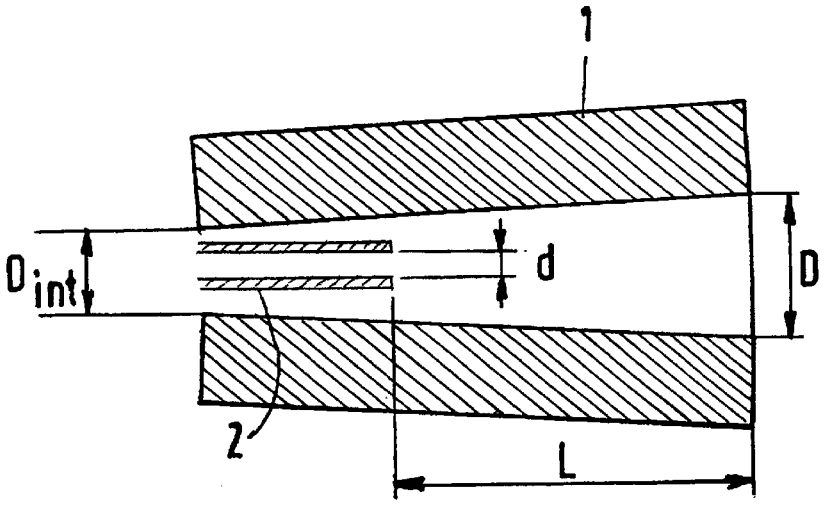
FIG. 1 illustrates a vertical cross-sectional view through a (glory hole/atomizer) system.

Referring to the drawing figures, like reference numerals designate identical or corresponding elements throughout the several figures.

According to aspects of the present invention, the necessary setback of the end of the injector with respect to the downstream end of the glory hole in the gas flow direction is determined so as to obtain stability and viable positioning of the flame, as a function of generic characteristics of the fuel, oxidizer, atomizer, and glory hole system.

In general, it is known that it is possible to analyse the stability of a two-phase flame (liquid and gas) with the aid of three characteristic times. These times are a chemical time, a vaporization time and a characteristic time of mixing. Definitions of these terms can be found in the article by D. Stepowski, A. Cessou and P. Goix , "Flame stabilization and OH fluorescence mapping of the combustion structures in the near field of a spray jet", Combustion and Flame, volume 99, page 516–522, 1994.

Within the context of the present invention, two parameters are defined: a stability parameter ("S"); and an attachment parameter ("A"). These numbers correspond, respectively, to the ratio of a vaporization time to a mixing time, and to the ratio of a chemical time to a mixing time.

There are two major categories of liquid-fuel atomizers. For each of these two categories, an equivalent velocity $V_{equivalent}$ is defined which is representative of the average velocity of the spray of drops.

For so-called assisted atomizers, it is possible to associate an atomization velocity, hereinafter denoted $V_{atomization}$. This velocity is the velocity of the gas flow which ensures atomization. Typically, internal atomizers have low atomization velocities (50 m/s min) and external atomizers have high atomization velocities (250 m/s max). The equivalent velocity is then related to the atomization velocity by the relation:

$$V_{equivalent}=0.5\cdot V_{atomization}$$

In the case of so-called mechanical atomizers, the equivalent velocity of the spray as a function of the internal diameter "d" of the atomizer (defined in FIG. 1) and of the liquid flow rate (denoted M in kg/s) is given by the formula:

$$V_{equivalent}=2.4\ M/(\rho\pi d^2)$$

A typical order of magnitude for mechanical atomizers is an equivalent velocity of 50 m/s.

It is possible to introduce a tangential component into the velocity of injection of the liquid or into the velocity of injection of the oxidizer gas ("swirl") which tends to reduce the equivalent velocity.

According to the invention, the process for combustion with the aid of a liquid fuel and a gaseous oxidizer containing from 20% to 100% vol. of oxygen in which the fuel is injected with the aid of an injector 2 of internal height "d" placed inside a glory hole 1 of internal height "D" at its end corresponding to the ejection of the gaseous mixture towards the zone of heating of a charge, is characterized in that the coefficient S, defined by the relation:

$$S=\frac{a_1 V_{equivalent}-a_2 L}{a_3 d(2-e^{-L/10D})}$$

with $a_1=2.5\cdot 10^{-11}$, seconds $a_2=1\cdot 10^{-9}$, dimensionless $a_3=(0.875\cdot\gamma+0.525)\cdot 10^{-6}$, dimensionless is maintained at a value less than or equal to 1 (S<=1) for substantially the entire duration of combustion, so as to ensure the stability of the flame, L being defined as the distance between the end of the liquid fuel injector and the downstream end in the fluid flow direction of the glory hole 1, $V_{equivalent}$ being defined either as the equivalent velocity representative of the average velocity of the spray of drops of liquid fuel in the case of mechanical atomizers and being equal to 2.4 $M/(\rho\pi d^3)$, or a velocity equal to 0.5 times $V_{atomizatiion}$, in other cases, $\gamma$ being defined as the overall (volume) percentage of oxygen in the gases at the exit of the glory hole 1, e.g., 70% oxygen means $\gamma$=0.7. In the case of staged-flame burners or separate injections, only the gases feeding the primary zone of the flame or surrounding the separate injection of fuel will be taken into account for the calculation of $\gamma$.

In general, a stable flame can be:

1. attached to the nose of the injector,
2. detached, but stable in the glory hole,
3. detached outside the glory hole.

The detached flame (cases 2 and 3) will stabilize a certain distance from the injector. If this distance increases, the risks of the flame blowing out also increase, calling into question the integrity of the installation.

The process according to one aspect of the present invention, for maintaining a flame attached to the nose of the injector or detached but stable, without any risk of this flame being blown out, is characterized in that the parameter defined by the formula $$A=\frac{\tau V_{equivalent}}{d(2-e^{-L/10D})}\ \text{with}\ \tau=\frac{4.56}{(400\gamma-50)^2},\ \text{seconds}$$

is less than $A_{max}$, with $A_{max}$ given by:

$$A_{\max}=2\cdot\frac{\min(D_{\text{in}},D)}{d}.$$

In order to obtain a flame attached to the nose of the injector for substantially the entire combustion, the parameter A will be maintained at a value less than or equal to 1 (A<=1).

In the case where the flame is used in a hot environment, that is to say a furnace temperature of approximately ≧1100° C., it will be possible to use a combustion system with a coefficient A lying between 1 and $A_{max}$ ($1\leqq A\leqq A_{max}$).

In FIG. 1, the atomizer 2 is confined within the glory hole 1. FIG. 1 represents both the case of an axisymmetric geometry and the case of a parallelepipedal glory hole/atomizer. Four geometrical lengths are defined intrinsically: d, L, D and $D_{int}$. The internal diameter "d" is measured at the exit of the atomizer. The length "L" is the distance which separates the injection plane of the atomizer 2 and the exit plane of the glory hole 1 . $D_{int}$ and D are, respectively, the characteristic distances at the entrance and exit of the glory hole (diameter, for an axisymmetric geometry).

EXAMPLE 1

A combustion device is produced, which includes an injector of liquid fuel of diameter d=0.5 mm, in a substantially conical glory hole opening in the fluid flow direction and having a downstream aperture diameter D equal to 60 mm. To inject the liquid fuel, use is made of a device of the "internal atomization" type such as defined above. The atomization velocity of the fluid is 50 m/s, thus giving an equivalent velocity (as defined above) of 25 m/s.

Figure 2:
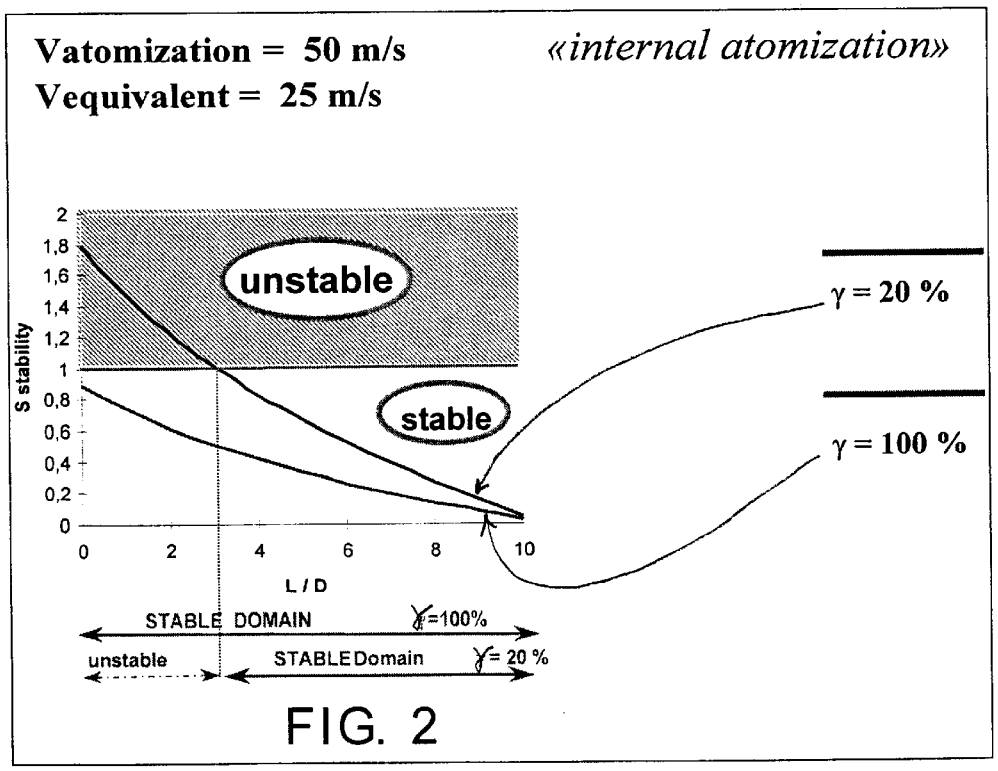
FIGS. 2 to 7 illustrate various curves defining the stability zones of the burner.

FIG. 2 represents two curves of the variation of the coefficient S as a function of the parameter L/D, for two different values of the coefficient y (respectively, 20% and 100%). When the position of the injector in the glory hole is varied, in such a way that the ratio L/D varies between 0 and 10, the coefficient S retains a value of less than 0.9 ($\gamma$=100%) and less than 1.0 ($\gamma$20%) for approximately L/D>3, respectively, and, in practice, the corresponding stability of the flame is verified.

EXAMPLE 2

A combustion device is produced, which includes an injector of liquid fuel of diameter d=1.8 mm, in a substantially conical glory hole opening in the fluid flow direction and having a downstream aperture diameter D equal to 86 mm. A combustion system is implemented with liquid-fuel injection for external atomization with a liquid atomization velocity equal to 250 m/s, i.e., an equivalent velocity (defined above) of around 125 m/s.

Figure 3:
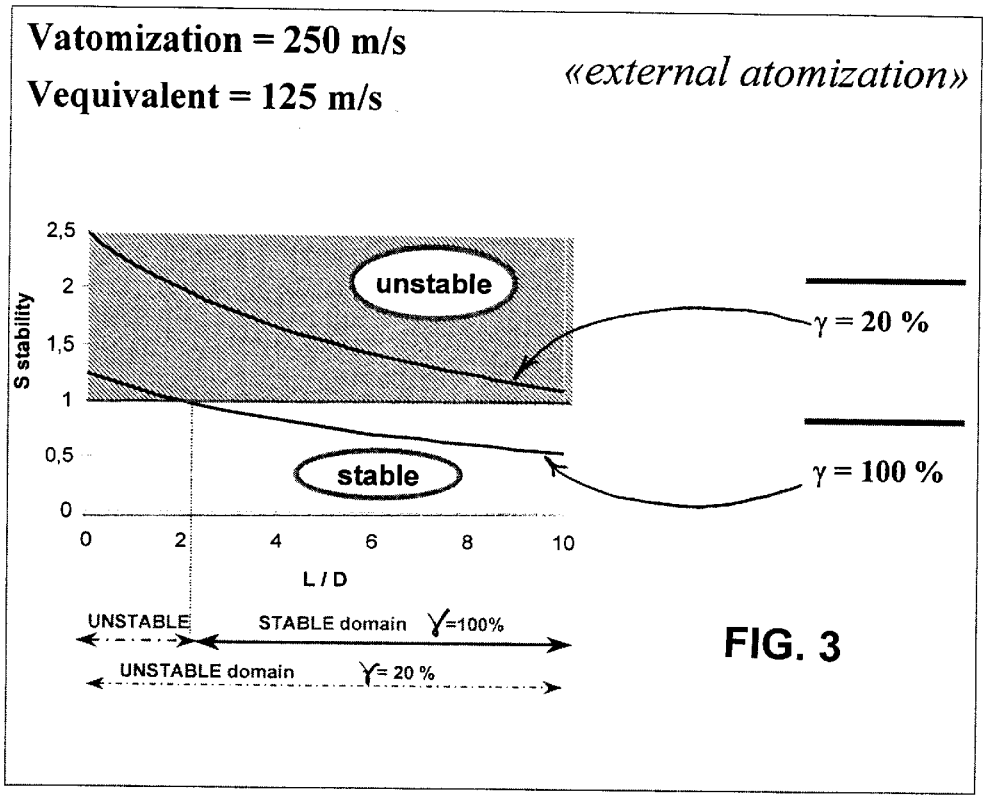

In FIG. 3, the curves S=f (L/D) are plotted for $\gamma$=20% and $\gamma$=100% (as before), and it is verified by experiment that the flame is never stable for $\gamma$=20% and is stable only beyond a value L/D of around 2.2 for $\gamma$=100%.

EXAMPLE 3

Figure 4:
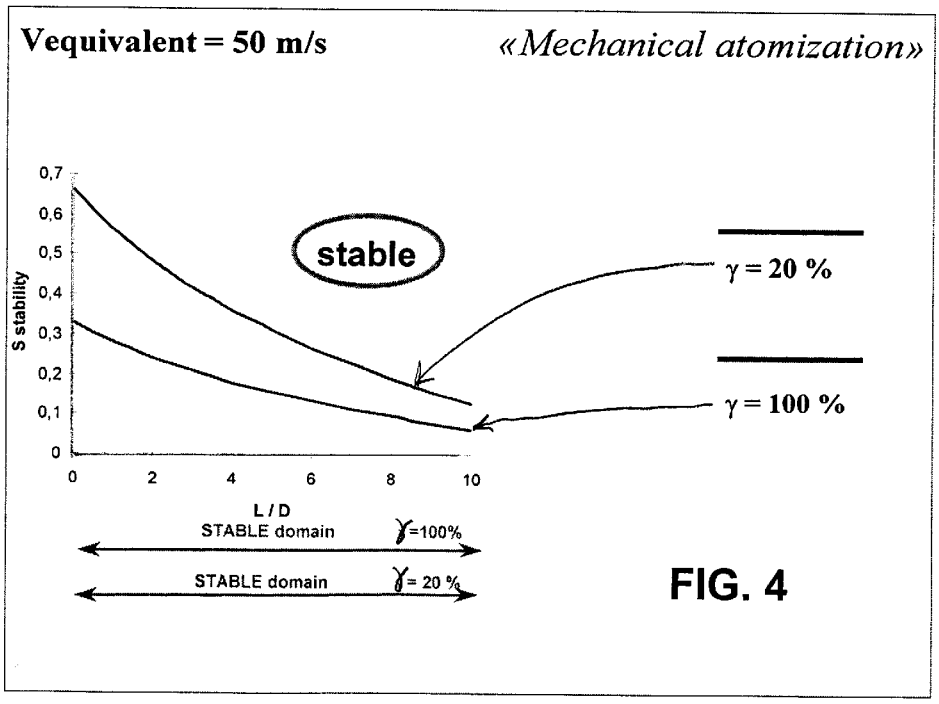

Under the same conditions as in Example 2, but with d=2.7 mm and D=86 mm, with the aid of a mechanical atomization device and an equivalent velocity of 50 m/s, the results represented in FIG. 4 are obtained. For both $\gamma$=100% and $\gamma$=20%, no stability problem is observed. See FIG. 4.

EXAMPLE 4

Under the same conditions as in Example 1, the percentage of oxygen $\gamma$ has been made to vary between 20% and 100% vol.

Figure 5:
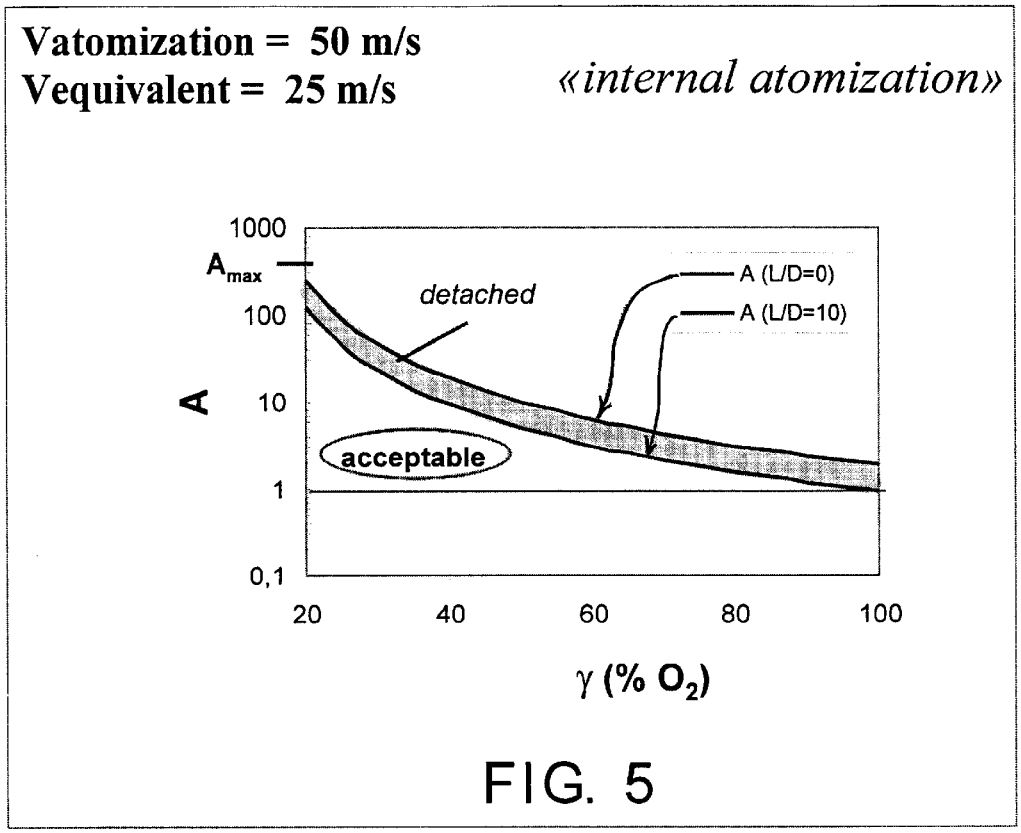

It is found (FIG. 5) that for L/D=0, the flame remains is detached but within the acceptable limits of stability in both cases.

EXAMPLE 5

Figure 6:
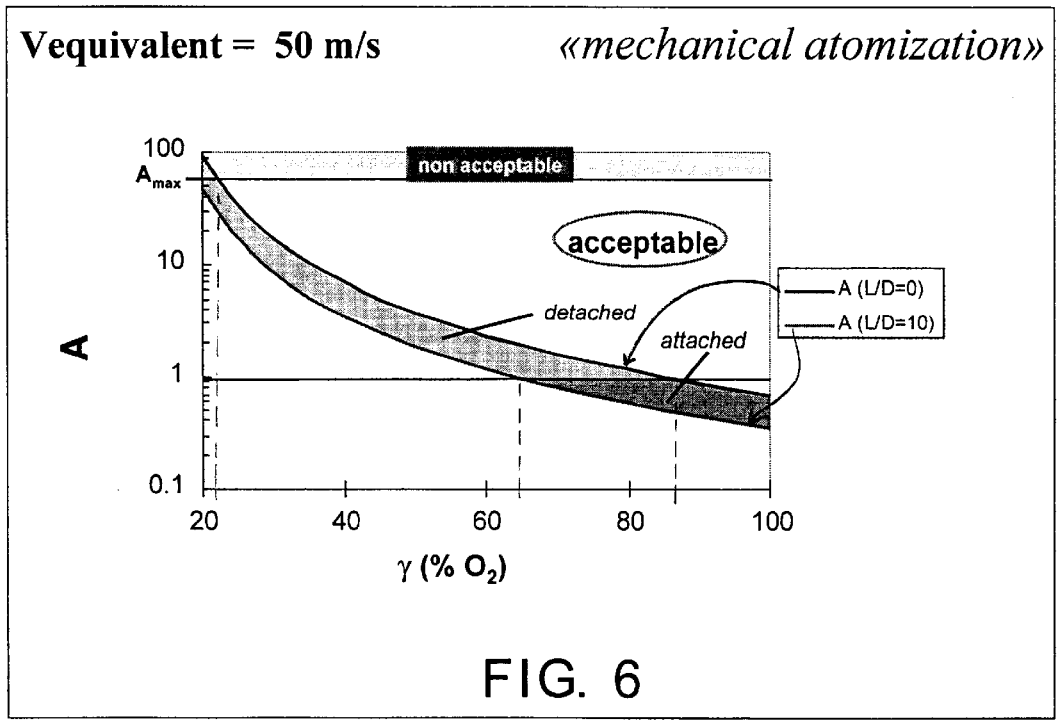

This example is implemented under the same conditions as Example 3. In this example it is found (FIG. 6) that for L/D=0, the flame remains attached for approximately 88%≦$\gamma$≦100%, and is detached but within acceptable limits of stability for approximately 20%≦$\gamma$≦88%. For approximately $\gamma$≦22%, $A_{max}$ is exceeded, and the stability of the flame is unacceptable. For L/D =10, the flame remains attached for approximately 66%≦$\gamma$≦100%, and is detached but within acceptable limits of stability for 20%≦$\gamma$≦66%.

It is found however that the combustion system with L/D=0 is not acceptable if it operates with air. The device described in the present example is especially well suited to the use of oxygen originating from an adsorption apparatus of the VSA type (Vacuum Swing Adsorption), the purity of which may vary between 88% of oxygen up to 98% 02, the remaining percentage being essentially argon, with a little residual nitrogen.

EXAMPLE 6

Figure 7:
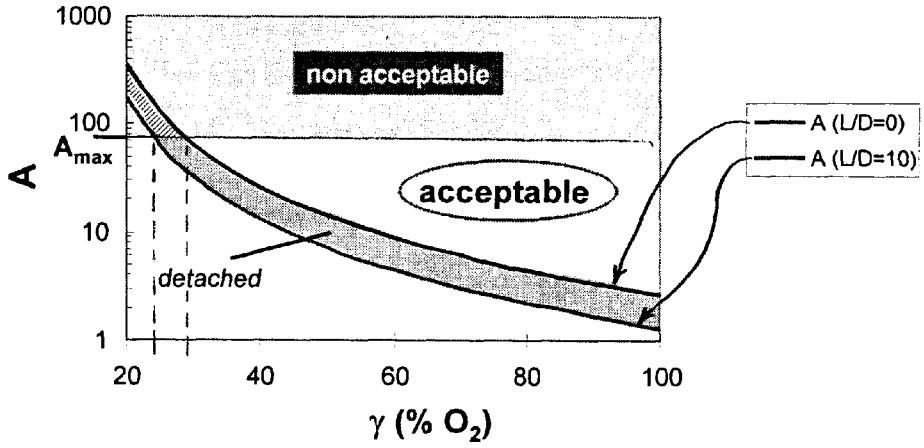

The conditions of implementation of this example are similar to those of Example 2 and the results are represented in FIG. 7. In this example it is found that for L/D=0, the flame is detached for approximately 30%≦$\gamma$≦100% but within acceptable limits of stability, and for approximately $\gamma$≦30% $A_{max}$ is exceeded and the stability of the flame is unacceptable. For L/D=10, the flame is detached for approximately 25%≦$\gamma$≦100% but within acceptable limits of stability, and for approximately $\gamma$≦25% $A_{max}$ is exceeded and the stability of the flame is unacceptable.

Other variants within the scope of the present invention will be readily appreciated by the person skilled in the art. Thus, preferably one will avoid positioning the liquid-fuel injector set too far back with respect to the downstream end of the glory hole, so as to preclude the jet of fine liquid-fuel droplets from coming into direct contact with internal walls of the glory hole. By the theory of jets, it is known that the angle of the jet will be of the order of 120, which makes it possible by simple calculation to thus prefer a ratio L/D<6.

While the invention has been described in detail with reference to preferred embodiments thereof, it will be apparent to one skilled in the art that various changes can be made, and equivalents employed, without departing from the scope of the invention. Each of the aforementioned published documents is incorporated by reference in its entirety herein.

What is claimed is:

1. A process for combustion with the aid of a liquid fuel and a gaseous oxidizer containing from 20% to 100% volume of oxygen, comprising the steps of:

injecting the fuel with an injector having an internal height d placed inside a glory hole having an internal height D at its end corresponding to the ejection of the gaseous mixture towards the zone of heating of a charge; maintaining the coefficient S defined by the relation:

$$S = \frac{a_1 V_{equivalent} - a_2 L}{a_3 d(2 - e^{-L/10D})}$$

with $a_1=2.5\cdot10^{-11}$, seconds $a_2=1\cdot10^{-9}$, dimensionless $a_3=(0.875\cdot\gamma+0.525)\cdot10^{-6}$, dimensionless, at a value less than or equal to 1 for substantially the entire duration of combustion;

wherein L is defined as the distance between the end of the liquid fuel injection and a downstream end in the fluid flow direction of the glory hole, $V_{equivalent}$ is defined either as the equivalent velocity representative of the average velocity of the spray of drops of liquid fuel in the case of mechanical atomizers and being equal to 2.4 $M/(\rho\pi d^2)$, or a velocity equal to 0.5 times $V_{atomization}$, and $\gamma$ is defined as the overall (volume) percentage of oxygen in the gases at the exit of the glory hole.

2. The process according to claim 1, wherein the parameter defined by the formula:

$$A = \frac{\tau V_{equivalent}}{d(2 - e^{-L/10D})} \text{ with } \tau = \frac{4.56}{(400\gamma - 50)^2}, \text{ seconds}$$

is less than $A_{max}$, with $$A_{\max} = 2 \cdot \frac{\min(D_{\text{in}}, D)}{d}.$$

3. The process according to claim 2, comprising:

maintaining $A \leqq 1$ to maintain a flame substantially attached to the nose of the injector.

4. The process according to claim 2, comprising:

maintaining $1 \leqq A \leqq A_{max}$; and maintaining the temperature of the furnace at a temperature $\geqq 1100°$ C.

5. A method of operating a liquid fuel combustion burner comprising:

providing a glory hole with fuel injector place insider, the glory hole having an internal height D at a downstream end, the fuel injector having an internal height d, and a distance from an end of the fuel injector to a downstream end of the glory hole is L;

delivering a liquid fuel to the fuel injector and delivering a gaseous oxidizer to the glory hole to maintain a coefficient S defined by the relationship:

$$S = \frac{a_1 V_{equivalent} - a_2 L}{a_3 d(2 - e^{-L/10D})}$$

at a value less than or equal to 1 for substantially the entire duration of combustion; wherein:

$a_1 = 2.5 \times 10^{-11}$ seconds $a_2 = 1 \times 10^{-9}$ $a_3 = (0.875 \times \gamma + 0.525) \times 10^{-6}$ $V_{equivalent}$ is defined either as the equivalent velocity representative of the average velocity of the spray of drops of liquid fuel in the case of mechanical atomizers and being equal to 2.4 $M/p\pi d^2$), or a velocity equal to 0.5 times $V_{atomization}$, and $\gamma$ is defined as the overall (volume) percentage of oxygen in the gases at the exit of the glory hole.

6. The method according to claim 5, wherein the parameter defined by the formula:

$$A = \frac{\tau V_{equivalent}}{d(2 - e^{-L/10D})} \text{ with } \tau = \frac{4.56}{(400\gamma - 50)^2}, \text{ seconds}$$

is less than $A_{max}$, with $$A_{\max} = 2 \cdot \frac{\min(D_{\text{in}}, D)}{d}.$$

7. The method according to claim 6, comprising:

maintaining $A \leqq 1$ to maintain a flame substantially attached to the nose of the injector.

8. The method according to claim 6, comprising:

maintaining $1 \leqq A \leqq A_{max}$; and maintaining the temperature of the furnace at a temperature $\leqq 1100°$ C.

* * * * *